US011007425B2

(12) United States Patent
Chan

(10) Patent No.: US 11,007,425 B2
(45) Date of Patent: May 18, 2021

(54) SLIDING INTELLIGENCE TOY

(71) Applicant: Hok Yin Chan, Shatin (HK)

(72) Inventor: Hok Yin Chan, Shatin (HK)

( * ) Notice: Subject to any disclaimer, the term of this patent is extended or adjusted under 35 U.S.C. 154(b) by 174 days.

(21) Appl. No.: 16/476,398

(22) PCT Filed: Apr. 8, 2019

(86) PCT No.: PCT/IB2019/052858
§ 371 (c)(1),
(2) Date: Jul. 8, 2019

(87) PCT Pub. No.: WO2019/197960
PCT Pub. Date: Oct. 17, 2019

(65) Prior Publication Data

US 2020/0276495 A1 Sep. 3, 2020

(30) Foreign Application Priority Data

Apr. 13, 2018 (HK) ..... 18104843.1

(51) Int. Cl.
*A63F 9/08* (2006.01)

(52) U.S. Cl.
CPC ..... *A63F 9/0857* (2013.01); *A63F 9/0838* (2013.01); *A63F 9/0869* (2013.01); *A63F 2009/0846* (2013.01)

(58) Field of Classification Search
CPC .... A63F 9/0857; A63F 9/0838; A63F 9/0869; A63F 2009/0846; A63F 2009/0884; A63F 9/083
See application file for complete search history.

(56) References Cited

U.S. PATENT DOCUMENTS 4,949,969 A * 8/1990 Johnson ..... A63F 9/001 273/153 R
4,983,062 A * 1/1991 Hour ..... A63F 9/001 273/153 S
5,116,053 A * 5/1992 Blankenburg ..... A63F 9/0811 273/153 S
6,460,849 B1 * 10/2002 Bean ..... A63F 9/0811 273/155

(Continued)

FOREIGN PATENT DOCUMENTS

CN 2143127 Y * 10/1993
CN 2380271 Y * 5/2000

(Continued)

*Primary Examiner* — Steven B Wong
(74) *Attorney, Agent, or Firm* — Muncy, Geissler, Olds & Lowe, P.C.

(57) ABSTRACT

A sliding intelligence toy including a housing, two fixed pads fixed at two inner ends of the housing, a movable pad located between the two fixed pads, a connecting shaft structure passing through the two fixed pads and the movable pad, a first block structure and a second block structure. One end of the connecting shaft structure sticks out from one end of the housing and can move along the axial direction of the housing and rotate along the radial direction of the housing under the action of an external force, and the movable pad can rotate with the rotation of the connecting shaft structure. The sliding intelligent toy has a simple game principle, can be operated easily and flexibly and set clear levels of difficulty, which is challenging.

20 Claims, 9 Drawing Sheets

(56) References Cited

U.S. PATENT DOCUMENTS

| | | | | |
|---|---|---|---|---|
| 7,168,703 | B2 * | 1/2007 | Lammertink | A63F 9/0803 273/153 S |
| 7,275,744 | B1 * | 10/2007 | Kuo | A63F 9/001 273/153 S |
| 8,251,366 | B1 * | 8/2012 | Nathan | A63F 9/0811 273/153 S |
| 2006/0061033 | A1 * | 3/2006 | Han | A63F 9/083 273/153 S |

FOREIGN PATENT DOCUMENTS

| | | | | | |
|---|---|---|---|---|---|
| CN | 204706229 | U | * | 10/2015 | |
| GB | 2486896 | A | * | 7/2012 | A63F 9/0838 |
| SU | 1319888 | A1 | * | 6/1987 | A63F 9/083 |

* cited by examiner

SLIDING INTELLIGENCE TOY

TECHNICAL FIELD

The present invention relates to the technical field of toys, particularly to a sliding intelligence toy.

BACKGROUND ART

Generally, a sliding intelligence toy is played by disorganizing number or color blocks and then reorganizing them to initial positions. The basic operation method is to move the blocks horizontally or vertically or swap them to change the positions of the blocks. Most of the existing sliding intelligence toys have the disadvantages of complex and inflexible operation, not clearly defined difficulty levels and a complex game principle and cannot meet the game play requirements.

SUMMARY OF THE INVENTION

The objective of the present invention is to overcome the defects of the foregoing technology and provide a sliding intelligence toy, which has a simple game principle, sets clear levels of difficulty and can be operated easily.

The present invention provides a sliding intelligence toy, comprising a housing, two fixed pads fixed at two inner ends of the housing, a movable pad located between the two fixed pads, a connecting shaft structure passing through the two fixed pads and the movable pad, a first block structure and a second block structure; one end of the connecting shaft structure sticks out from one end of the housing and can move along the axial direction of the housing and rotate along the radial direction of the housing under the action of an external force, and the movable pad may rotate with the rotation of the connecting shaft structure; a push pad is vertically arranged on a side of each of the fixed pads, and sleeved to the connecting shaft structure and can move on a corresponding fixed pad with the movement of the connecting shaft structure; the first block structure comprises at least three closely adjacent first blocks slidably arranged in order on one side of the two fixed pads and the movable pad, the at least three first blocks are sandwiched between the push pads of the two fixed pads and the two first blocks at two ends are respectively located on the side of the corresponding fixed pads, and remaining first blocks are located on the side of the movable pad; the second block structure comprises at least one second block slidably arranged at the bottom of the movable pad; first marks are arranged on the at least three first blocks respectively and a second mark is arranged on the at least one second block; at most two blocks can be arranged on each of the fixed pads.

Further, on a side of each of the fixed pads and the movable pad there is a first slideway and a second slideway extending along the axial direction of the housing respectively, the first slideway corresponds to the second slideway, and at the bottom of the movable pad there is a third slideway extending along the axial direction of the housing; the push pads can move on a corresponding fixed pad along the first slideway with the movement of the connecting shaft structure; the at least three first blocks slidably are arranged inside the first slideways of the two fixed pads and inside the second slideway of the movable pad, the two first blocks at two ends are located inside the first slideways of corresponding fixed pads respectively, and remaining first blocks are located inside the second slideway of the movable pad, and the at least one second block is slidably arranged inside the third slideway; at most two blocks can be slidably arranged inside the first slideway of each of the fixed pads.

Further, on the housing there is a watch window corresponding to the first block structure.

Further, the housing comprises a housing body that is open at one end, an end cover that is connected to the open end of the housing body, and an end cover cap that is sleeved to the end cover, on the housing body there is a notch extending along the axial direction of the housing, and one end of the end cover cap has a protruding portion, which is inlaid in the notch to form the watch window.

Further, the two fixed pads are fixed to two inner ends of the housing body respectively, and the fixed pad located inside the open end of the housing body are butted on the end cover; a gasket is arranged at the inner bottom of the housing body, and the fixed pad located at the inner bottom of the housing body is butted on the gasket.

Further, the connecting shaft structure comprises a connecting shaft and a handle fixed to one end of the connecting shaft, and one end of the handle sticks out from one end of the housing; buckle positions are provided at two ends of the connecting shaft, and the two push pads are respectively sleeved to the corresponding buckle positions.

Further, the cross-section of the connecting shaft is in a triangular shape, the movable pad has an axial triangular through hole coordinating with the connecting shaft, and the connecting shaft coordinates with the triangular through hole so that the movable pad can rotate with the rotation of the connecting shaft structure.

Further, the sliding intelligence toy further comprises a magnetic self-aligning device to drive the connecting shaft structure to automatically go back to an initial position; the magnetic self-aligning device comprises a first magnetic block and a second magnetic block, the first magnetic block is mounted inside the end cover of the housing, and the second magnetic block is mounted inside the handle of the connecting shaft structure and adjacent to the connecting shaft of the connecting shaft structure.

Further, the first magnetic block is a magnetic pole, and the second magnetic block is a magnetic ball.

Further, each of the fixed pads has an axial through hole, and the connecting shaft structure is sleeved into the through hole.

Further, each of the push pads comprises a connecting portion and a butting portion formed on the periphery of the connecting portion, the connecting portion is sleeved to the connecting shaft structure, the butting portion comprises a first portion formed on the periphery of the connecting portion and a second portion connected to an end of the first portion, the top of the fixed pad has an opening communicated with the through hole, the first portion sticks out from the opening, and the second portion is around a side of the fixed pad adjacent to the first slideway.

Further, first lugs protruding inwardly are arranged on two side walls of the first slideway respectively, and second lugs are arranged on inner side of the second portion and buckled between the first lugs on two side walls of the first slideway; two of the at least three first blocks that are located at two ends are butted against the second lugs of corresponding push pads.

Further, the sliding intelligence toy further comprises a pad cover, which is fixed inside the housing, surrounds the periphery of the movable pad and has a recess corresponding to the first block structure; the inner periphery of the pad cover has a limiting portion, which is intended to limit the rotation angle of the movable pad.

Further, the first block structure comprises three first blocks, and the second block structure comprises a second block.

Further, first marks arranged on the first blocks are numbers and the numbers on three first blocks are continuous; second marks arranged on the second blocks are English letters.

Further, the first block structure comprises five first blocks and the second block structure comprises three closely adjacent second blocks arranged in order.

Further, first marks arranged on the first blocks are numbers and the numbers on five first blocks are continuous; second marks arranged on the second blocks are English letters and the English letters on three second blocks are continuous.

Further, an included angle is formed between the second slideway of the movable pad and the third slideway of the movable pad, and the symmetric center line of the included angle coincides with the symmetric center line of one of the angles of the triangular through hole.

Further, the sliding intelligence toy further comprises a magnetic rotation correction system, which is intended to automatically complete a step of swapping and comprises third magnetic blocks and fourth magnetic blocks.

Further, the third magnetic blocks are mounted at the center of the pad cover, and the fourth magnetic blocks are mounted at two ends of the back of the movable pad.

The intelligent toy provided by the present invention has a novel appearance, a simple game principle and a concise game interface, can be operated easily and flexibly and sets clear levels of difficulty, which is challenging.

DETAILED DESCRIPTION

Figure 1:
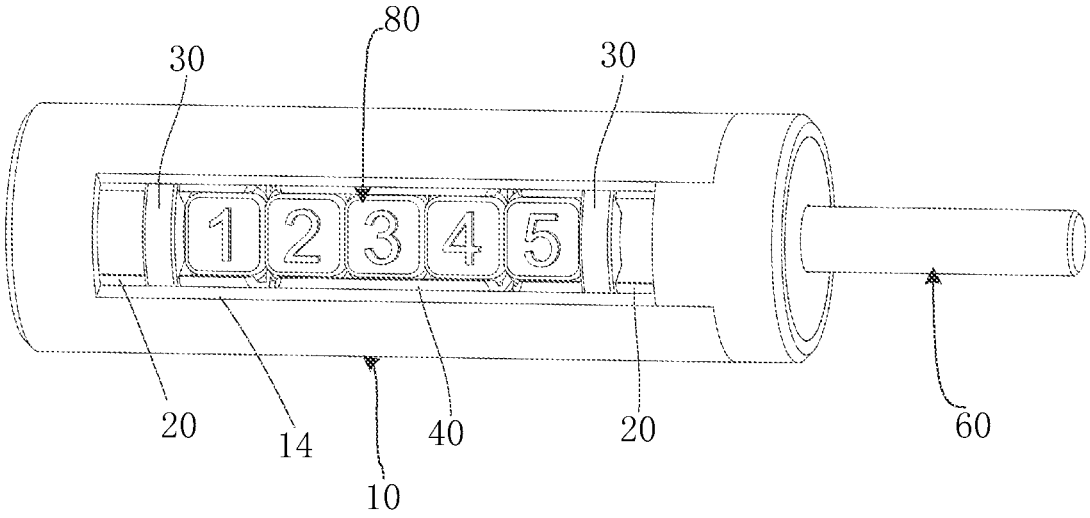
FIG. 1 is a structural schematic view of a sliding intelligence toy provided by the first embodiment of the present invention.
Figure 2:
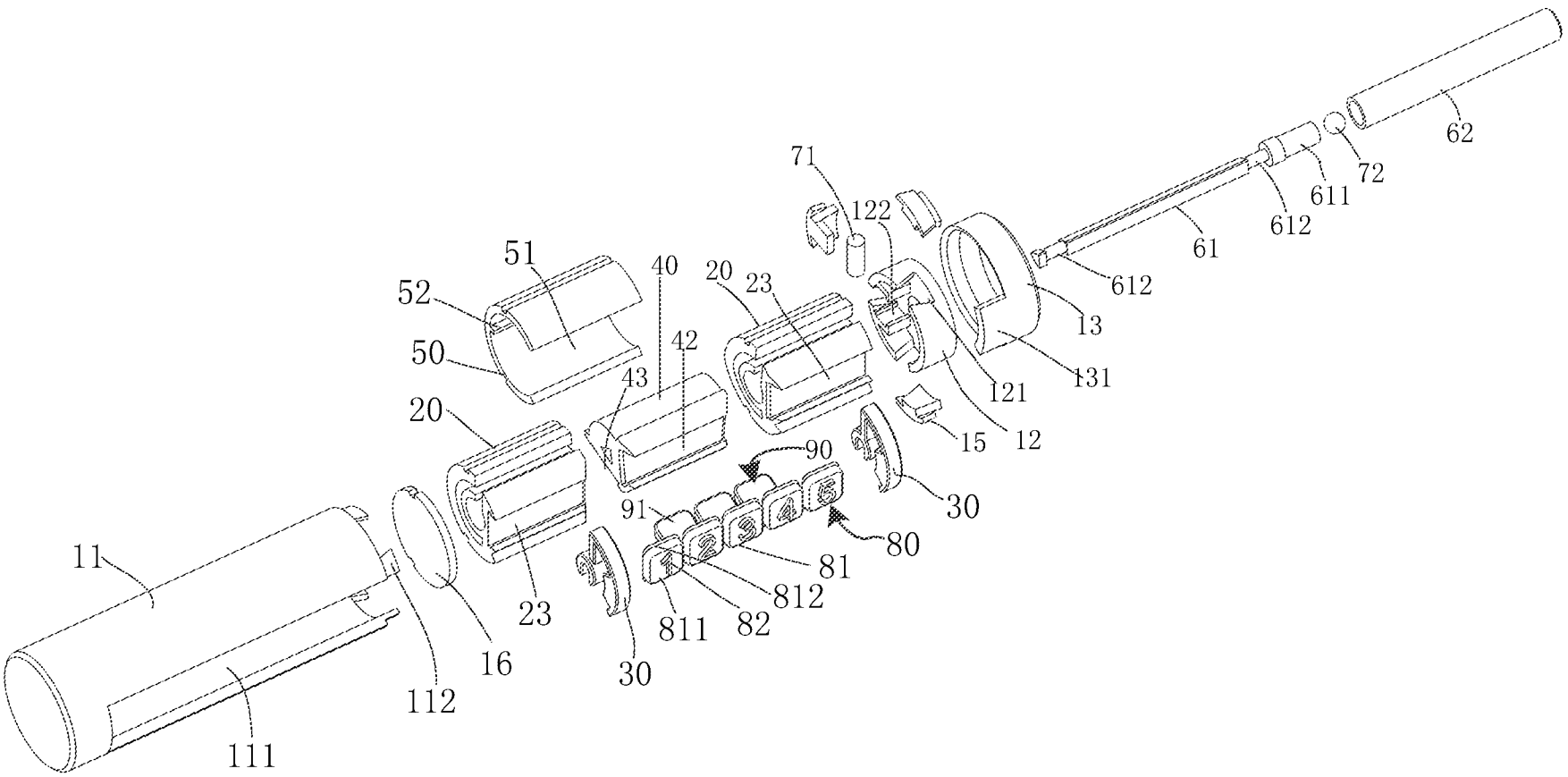
FIG. 2 is an exploded schematic view of the sliding intelligence toy shown in FIG. 1.
Figure 3:
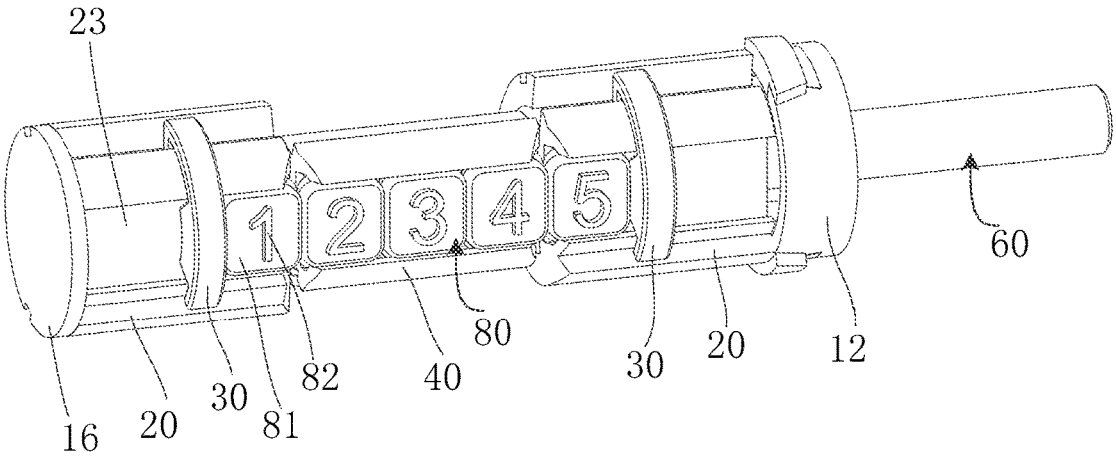
FIG. 3 is a structural schematic view of the sliding intelligence toy shown in FIG. 1 after removal of the housing body, end cover cap and pad cover.
Figure 4:
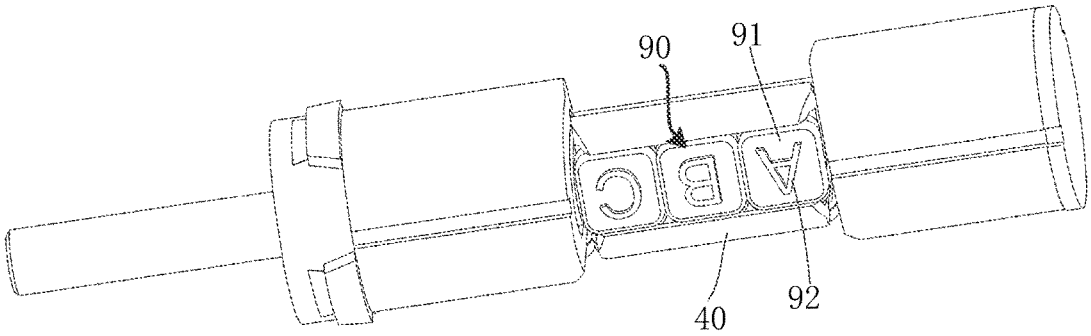
FIG. 4 is a structural schematic view of the sliding intelligence toy shown in FIG. 3, with a second block structure being displayed.

Below the present invention will be further described with reference to accompanying drawings and embodiments.

Embodiment 1

With reference to FIG. 1~FIG. 8, the present invention provides a sliding intelligence toy, which is a new type of sliding intelligence toy, with a shape of a popsicle, a color that can be set according to need and a novel appearance. The sliding intelligence toy comprises a cylindrical housing 10, two fixed pads 20 fixed at two inner ends of the housing 10, a movable pad 40 located between the two fixed pads 20, a pad cover 50, a magnetic self-aligning device 70, a connecting shaft structure 60 passing through the two fixed pads 20 and the movable pad 40, a first block structure 80 and a second block structure 90. One end of the connecting shaft structure 60 sticks out from one end of the housing 10 and can move along the axial direction of the housing 10 and rotate along the radial direction of the housing 10 under the action of an external force, and the movable pad 40 can rotate with the rotation of the connecting shaft structure 60. On the housing 10 there is a watch window 14 corresponding to the first block structure 80, which is convenient for the operator to observe the position of the block of the first block structure 80 or the second block structure 90.

The housing 10 comprises a housing body 11 that is open at one end, an end cover 12 that is connected to the open end of the housing body 11, and an end cover cap 13 that is sleeved to the end cover 12. On the housing body 11 there is a notch 111 extending along the axial direction of the housing 10, and one end of the end cover cap 13 has a protruding portion 131, which is inlaid in the notch 111 to form the foregoing watch window 14. Preferably, the outer peripheral surface of the end cover cap 13 is flush with the outer peripheral surface of the housing body 11.

The end cover 12 is connected to the housing body 11 mainly through the following structures: a number of tenon portions 112 are evenly arranged along the circumferential direction of the open end of the housing body 11 and buckled on the periphery of the end cover 12, a tenon position 121 is arranged between two adjacent tenon portions 112 on the outer peripheral surface of the end cover 12, and each tenon position 121 and two adjacent tenon portions 112 close to the tenon position 121 are locked with a tenon piece 15, thereby connecting the end cover 12 to the housing body 11. As the end cover cap 13 is sleeved to the end cover 12, the tenon piece 15 can be clamped inside the end cover cap 13, achieving a compact structure. In this embodiment, there are six tenon portions and three tenon positions, so there are three tenon pieces, too.

The two fixed pads 20 are fixed to two inner ends of the housing body 11 respectively. The fixed pad 20 located inside the open end of the housing body 11 are butted on the end cover 12. A gasket 16 is arranged at the inner bottom of the housing body, and the fixed pad located at the inner bottom of the housing body 11 is butted on the gasket 16.

The connecting shaft structure 60 comprises a connecting shaft 61 and a cylindrical handle 62. One end of the connecting shaft 61 is provided with a mounting portion 611, and a handle 62 is sleeved to the mounting portion 611 in a fixed manner. One end of the handle 62 sticks out from one end of the end cover 12 of the housing 10. When the handle 62 is pushed by a hand towards the inner bottom of the housing body 11, the connecting shaft 61 can move inside the two fixed pads 20 and the movable pad 40 towards the inner bottom of the housing body 11. When the handle 62 is pulled by a hand in a direction away from the inner bottom of the housing body 11, the connecting shaft 61 can move inside the two fixed pads 20 and the movable pad 40 in a direction away from the inner bottom of the housing body 11. When the handle 62 is rotated by a hand, the connecting shaft 61 can rotate inside the two fixed pads 20. The foregoing movement and rotation operations are easy, can be completed through two fingers. Preferably, the cross section of the connecting shaft 61 is in a triangular shape. Buckle positions 612 are provided at two ends of the connecting shaft 61.

Figure 5:
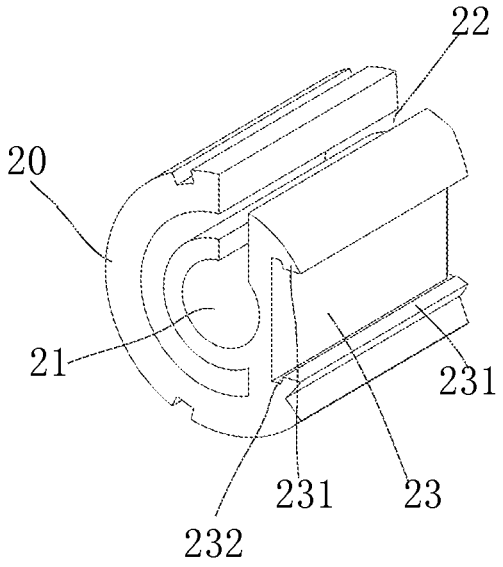
FIG. 5 is a structural schematic view of a fixed pad of the sliding intelligence toy shown in FIG. 1.
Figure 6:
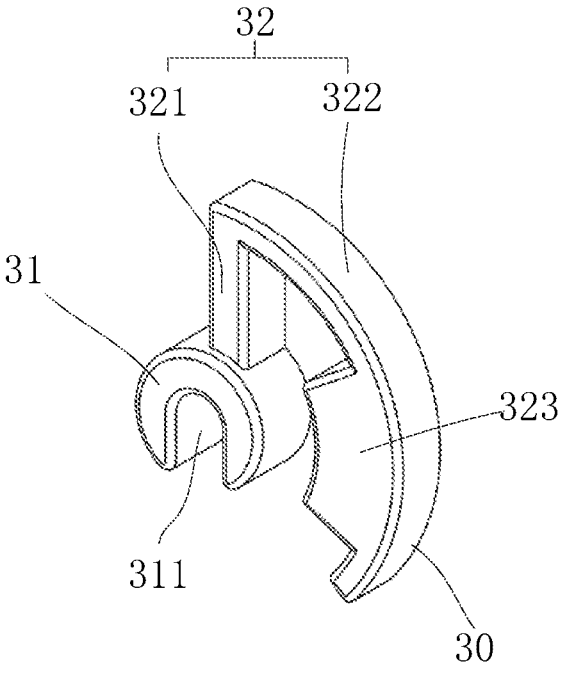
FIG. 6 is a structural schematic view of a push pad of the sliding intelligence toy shown in FIG. 1.

Each of the fixed pads 20 has an axial through hole 21, as shown in FIG. 5. The connecting shaft 61 is sleeved to the through hole 21. On a side of each of the fixed pads there is a first slideway 23 extending along the axial direction of the housing 10, and a push pad 30 is vertically arranged on a side adjacent to the first slideway 23. The push pad 30 is sleeved to a corresponding buckle position 612 of the connecting shaft 61 and can move on a corresponding fixed pad 20 along the first slideway 23 with the movement of the connecting shaft 61. To be specific, as shown in FIG. 6, a push pad 30 comprises a connecting portion 31 and a butting portion 32 formed on the periphery of the connecting portion 31. The connecting portion 31 has a U-shaped bayonet 311, which is sleeved to a corresponding buckle position 612 of the connecting shaft 61. The butting portion 32 comprises a first portion 321 formed on the periphery of the connecting portion 31 and an arc-shaped second portion 322 connected to an end of the first portion 321, the top of the fixed pad 20 has an opening 22 communicated with the through hole 21 (see FIG. 5), the first portion 321 sticks out from the opening 22, and the second portion 322 is around a side of the fixed pad 20 adjacent to the first slideway 23.

First lugs 231 protruding inwardly are arranged on two side walls of the first slideway 23 respectively, and second lugs 323 are arranged on inner side of the second portion 322 and buckled between the first lugs 231 on two side walls of the first slideway 23 so that the push pad 30 can move along the first slideway 23 with the movement of the connecting shaft 61. First sliding buckle positions 232 are formed between the first lugs 231 on two side walls of the first slideway 23 and the bottom of the first slideway 23 respectively. When the second lugs 323 of two push pads 30 move on the first slideway 23 of a corresponding fixed pad 20, the second lugs 323 of two push pads 30 are limited by a gasket 16 and an end cover 12 respectively, thereby preventing the push pads 30 from breaking away from the first slideway 23.

Figure 7:
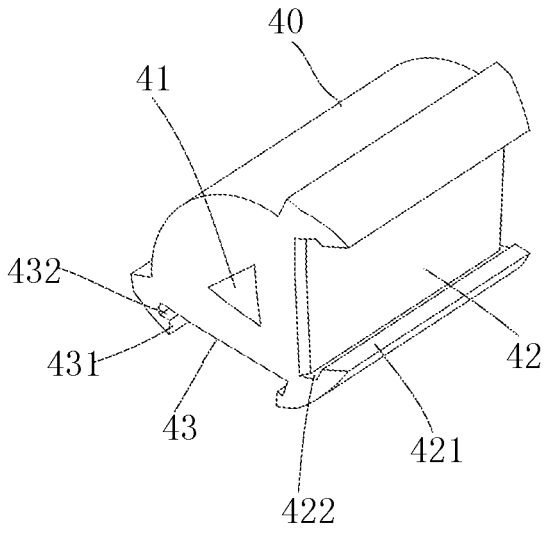
FIG. 7 is a structural schematic view of a movable pad of the sliding intelligence toy shown in FIG. 1.

The movable pad 40 has an axial triangular through hole 41 coordinating with the connecting shaft 61, as shown in FIG. 7, so that the movable pad 40 can rotate with the rotation of the connecting shaft 61. The triangular through hole 41 preferably is an equilateral triangular through hole. On one side of the movable pad 40 there is a second slideway 42 extending along the axial direction of the housing 10, and the first slideway 23 corresponds to the second slideway 42. Third lugs 421 protruding inwardly are arranged on two side walls of the second slideway 42 respectively, and second sliding buckle positions 422 are formed between the third lugs 421 and the bottom of the second slideway 42. At the bottom of the movable pad 40 there is a third slideway 43 extending along the axial direction of the housing 10, an acute angle is formed between the third slideway 43 and the second slideway 42. The symmetric center line of the included angle coincides with the symmetric center line of one of the angles of the triangular through hole 41 of the movable pad 40. Fourth lugs 431 protruding inwardly are arranged on two side walls of the third slideway 43 respectively, and third sliding buckle positions 432 are formed between the fourth lugs 431 and the bottom of the third slideway 43.

The first block structure 80 comprises at least three closely adjacent first blocks 81 slidably arranged in order inside a first slideway 23 and a second slideway 42. First marks 82 are arranged on the at least three first blocks 81, the two first blocks 81 at two ends are respectively located inside the first slideway 23 of a corresponding fixed pad 20 and abut on the second lugs 323 of a corresponding push pad 30, and remaining first blocks 81 are located inside the second slideway 42 of the movable pad 40. At most two blocks can be slidably arranged inside the first slideway 23 of each fixed pad 20. Preferably, a first block 81 comprises a rectangular pedestal 812 and a square main body 811 on the pedestal 812. Two sides of the pedestal 812 protrude from two sides of the main body 811. Two sides of the pedestals 812 of the first blocks 81 at two ends of the first block structure 80 are buckled to the first sliding buckle positions 232 of corresponding fixed pads 20 respectively. Two sides of the pedestals 812 of remaining first blocks 81 are buckled to the second sliding buckle positions 422 of corresponding movable pads 40 respectively.

The first block structure 80 of this embodiment comprises five first blocks 81. The five first blocks 81 are slidably arranged inside a first slideway 42 and a second slideway 43 in an orderly and closely adjacent manner. First marks 82 are arranged on the five first blocks 81 respectively. Preferably, the first marks 82 are numbers, and the numbers on the five first blocks 81 are continuous, for example, are 1, 2, 3, 4 and 5 in turn in a direction from the bottom of the housing body 11 to the end cover 12. It can be understood that the first marks 82 may also be uppercase English letters, lowercase English letters, colors, etc., for example, the uppercase English letters are A, B, C, D and E, and the lowercase English letters are a, b, c, d and e, and the colors are red, yellow, blue, green and purple. The first marks 82 may also be others such as patterns and symbols.

Among the five first blocks 81, the two first blocks 81 at two ends, i.e., the first blocks 81 marked as 1 and 5 are respectively located inside first slideways 23 of corresponding fixed pads 20 and abutting on second lugs 323 of corresponding push pads 30, and remaining three first blocks 81, i.e. the first blocks 81 marked as 2, 3 and 4 are located inside the second slideway 42. The first slideway 23 of each of the fixed pads 20 can accommodate two blocks. When the handle 62 is pushed by a hand towards the inner bottom of the housing body 11, the push pad 30 adjacent to the open end of the housing body 11 will, under the drive of the connecting shaft 61, push the first block structure 10 to move towards the inner bottom of the housing body 11. When the push pad 30 adjacent to the inner bottom of the housing body 11 abuts on the gasket 16, two first blocks 81, i.e., the first blocks 81 marked as 1 and 2 are received in the first slideway 23 of the fixed pad 20 located at the inner bottom of the housing body 11. Likewise, when the handle 62 is pulled by a hand in a direction away from the inner bottom of the housing body 11, the push pad 30 adjacent to the inner bottom of the housing body 11 will, under the drive of the connecting shaft 61, push the first block structure 10 to move away from the inner bottom of the housing body 11 (i.e., move towards the end cover 12). When the push pad 30 adjacent to the open end of the housing body 11 abuts on the end cover 12, two first blocks 81, i.e., the first blocks 81 marked as 4 and 5 are received in the first slideway 23 of the fixed pad 20 located at the open end of the housing body 11.

The second block structure 90 comprises at least one second block 91 slidably arranged inside a third slideway 43. Second marks 92 are arranged on the at least one second block 91. When the number of the second blocks 91 is greater than one, the second blocks 91 are closely adjacent to each other in order. The second block 91 is structurally same as the first blocks 81 and comprises a rectangular pedestal and a square main body arranged on the pedestal. Two sides of the pedestal protrude from two sides of the main body respectively. Two sides of the pedestals of the second blocks 91 of the second block structure 90 are buckled to the third sliding buckle positions 432 of the movable pad 40.

The second block structure 90 in the embodiment comprises three second blocks 91. The three second blocks 91 are slidably arranged inside a third slideway 43 in an orderly and closely adjacent manner. Second marks 92 are arranged on the three second blocks 91. Preferably, the second marks 92 are uppercase English letters, for example, A, B and C in turn in a direction from the bottom of the housing body 11 to the end cover 12. It can be understood that the second marks 92 may also be numbers, lowercase English letters, colors, etc., for example, the numbers are 1, 2 and 3, the lowercase English letters are a, b and c and the colors are red, yellow and purple. The second marks 92 may also be others such as patterns and symbols as long as it is assured that the first marks 82 and the second marks 92 are different. In an initial state, the first block structure 80 is displayed in a watch window 14, while the second block structure 90 is not displayed. If the second block structure 90 is to be displayed in the watch window 14, i.e., the positions of the first block structure 80 and the second block structure 90 are swapped, the handle 62 needs to be rotated. The movable pad 40 will rotate under the drive of the connecting shaft 61. When the second block structure 90 is located inside the watch window 14, the movable pad 40 will stop rotating. Now, the second block structure 90 can be displayed in the watch window 14, and second blocks 91 at two ends of the second block structure 90, i.e., the second blocks 91 marked as A and C are respectively adjacent to first blocks 91 of the first block structure 90 marked as 1 and 5. When the second block structure 90 is displayed in the watch window 14, the second blocks 91 of the second block structure 90 can be moved in a way of moving the first block structure 80, achieving swapping between the second blocks 91 of the second block structure 90 and the first block 81 of the first block structure 80.

Figure 8:
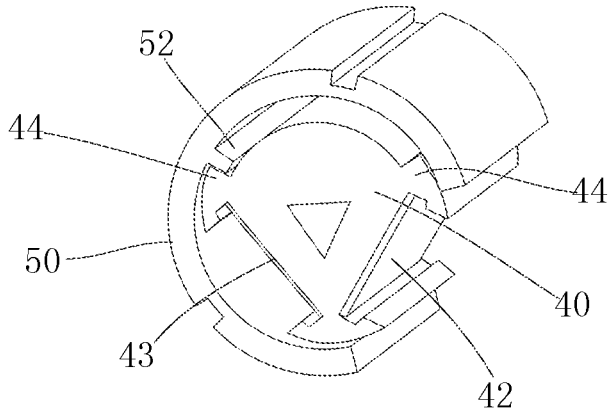
FIG. 8 is a structural schematic view of a pad cover and a movable pad of the sliding intelligence toy shown in FIG. 1.

A pad cover 50 is fixed inside the housing body 11. The pad cover 50 is located between two fixed pads 20, is around the periphery of a movable pad 40 and has a recess 51 corresponding to the first block structure 80, thereby displaying the first block structure 80 and concealing the second block structure 90. The inner periphery of the pad cover 50 has a limiting portion 52 that is intended to limit the rotation angle of the movable pad 40. To be specific, as shown in FIG. 8, an end of the third slideway 43 far from the included angle and an end of the second slideway 42 far from the included angle form fixture blocks 44. A vacancy is formed between the two fixture blocks 44, and the limiting portion 52 is buckled to a fixture block 44 adjacent to the third slideway 43. If the second block structure 90 is to be displayed in the watch window 14, the movable pad 40 needs to be rotated anticlockwise, in other words, the handle 62 is rotated anticlockwise. Now the limiting portion 52 is buckled to a fixture block 44 adjacent to the second slideway 42.

The magnetic self-aligning device 70 is intended to bring the connecting shaft structure 60 back to an initial position automatically when the external force disappears. To be specific, the magnetic self-aligning device 70 comprises a first magnetic block 71 and second magnetic block 72. The first magnetic block 71 is mounted in a mounting position 122 inside the end cover 12 of the housing 10. The mounting position 122 is located on a side of the inner bottom of the end cover 12, and the second magnetic block 72 is mounted inside the handle 62 of the connecting shaft structure 60 and adjacent to the connecting shaft 61. In a process of pushing, pulling or rotating the handle 62, after the hand is released, under the action of magnetic forces of the first magnetic block 71 and the second magnetic block 72, the connecting shaft structure 60 will be brought back to an initial position, i.e., all the structures are back to initial positions. It is user friendly and time and energy saving. Preferably, the first magnetic block 71 is a magnetic pole, and the second magnetic block 72 is a magnetic ball. It can be understood that the first magnetic block 71 and the second magnetic block 72 may be in other shapes.

Relative to existing sliding intelligence toys, the game play method of the present invention has three clearly defined levels of difficulty, namely: easy, difficult and extremely difficult, defined as follows: level 1: arrange English letters in order; level 2: arrange numbers in order; level 3: arrange English letters and numbers in order. Below level 1 is taken as an example to describe the play method of the present invention. For easy description, a fixed pad 20 located at the inner bottom of the housing body 11 is defined as a left fixed pad, and a fixed pad 20 located inside an open end of the housing body 11 is defined as a right fixed pad.

Let a second block 91 marked as A be in a position of a first block 81 marked as 1. Now the player needs to arrange three second blocks 91 of the second block structure 90 in order, i.e., the marks of the second blocks 91 in a direction from the bottom of the housing body 11 to the end cover 12 are A, B and C in turn.

Step 1: The handle 62 is pulled by a hand to a direction away from the inner bottom of the housing body 11. When first blocks 81 marked as 4 and 5 are both located inside the first slideway 23 of the right fixed pad, and a second block 91 marked as A and first blocks 81 marked as 2 and 3 are located inside the second slideway 42 of the movable pad 40, the handle 62 is rotated so that blocks located inside the third slideway 43 are displayed in the watch window 14. The blocks inside the third slideway 43 are a first block 81 marked as 1, a second block 91 marked as B and a second block 91 marked as C in turn.

Step 2: The handle 62 is pushed towards the inner bottom of the housing body 11. When a first block 81 marked as 1 is located inside the first slideway 23 of the left fixed pad, and a second block 91 marked as B, a second block 91 marked as C and a first block 81 marked as 4 are located inside the third slideway 43, the handle 62 is rotated so that blocks located inside the second slideway 42 are displayed in the watch window 14. The blocks inside the second slideway 42 are a second block 91 marked as A, a first block 81 marked as 2 and a first block 81 marked as 3 in turn.

Step 3: The handle 62 is pushed further towards the inner bottom of the housing body 11 so that a first block 81 marked as 1 and a second block 91 marked as A are located inside the first slideway 23 of the left fixed pad. Then the handle 62 is rotated so that blocks inside the third slideway 43 are displayed in the watch window 14. The blocks inside the third slideway 43 are a second block 91 marked as B, a second block 91 marked as C and a first block 81 marked as 4 in turn.

Step 4: The handle 62 is pulled away from the inner bottom of the housing body 11. When a second block 91 marked as A is located inside the third slideway 43, the handle 62 is rotated so that blocks inside the second slideway 42 are displayed in the watch window 14. The blocks inside the third slideway 43 are second blocks 91 marked as A, B and C in turn. After the hand is released, they return to initial positions under the action of the magnetic self-aligning device 70, in other words, the level-1 game of arranging English letters in order is completed. The play methods at level 2 and level 3 are similar and both are swapping of oppose positions of the blocks through operations of pushing, pulling, rotating and releasing the handle 62, thereby achieving the goals required by respective levels.

Embodiment 2

Figure 9:
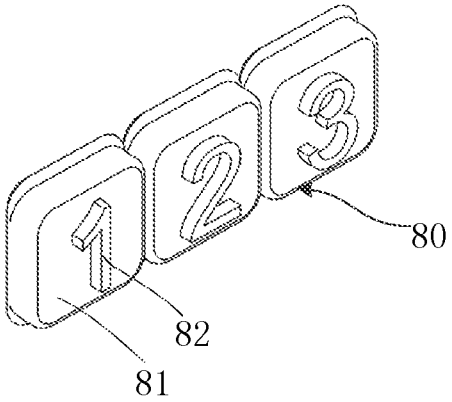
FIG. 9 is a structural schematic view of a first block structure of a sliding intelligence toy provided by the second embodiment of the present invention.

With reference to FIG. 9, this embodiment has the following difference from Embodiment 1: The first block structure 80 comprises three first blocks 81. First marks 82 of the three first blocks 81 are 1, 2 and 3 in turn in a direction from the bottom of the housing body 11 to the end cover 12. The second block structure 90 (not shown in the figure) comprises a second block 91. A second mark 92 of this second block 91 is A. This structure has fewer blocks and the play method is simple relative to Embodiment 1.

Whenever one block is added to the first block structure 80 and the second block structure 90 of the present invention respectively, the difficulty of the game will be approximately doubled. In other words, the more the blocks, the higher the difficulty. Further, without changing the original structure of the present invention, game difficulty can be changed by increasing or reducing blocks. The operation is flexible. In an initial state, or in a game process or in a restored state, the operator sees only blocks inside the watch window 14. The game interface is simplified.

In another embodiment, in order to raise the efficiency and accuracy of implementation of a swapping step, a magnetic rotation correction system may be added. As shown in FIG. 10-FIG. 14, the magnetic rotation correction system comprises third magnetic blocks 101 and fourth magnetic blocks 103. The third magnetic blocks 101 are mounted to mounting positions 105 of a pad cover 50, and the fourth magnetic blocks 103 are mounted to mounting positions 107 of a movable pad 40. The mounting positions 105 are located at the center of the pad cover 50, and the mounting positions 107 are located at two ends of the back of the movable pad 40. The third magnetic blocks 101 and the fourth magnetic blocks 103 are matched with the mounting positions 105 and the mounting positions 107 in dimensions and shape and can be stably stuck between them. Under the condition that blocks are pushed to a left position or pulled to a right position, when the handle 62 is rotated by a hand to a specific extent, for example, above a half of a full rotation range, the correction system will implement the rest actions. After the hand is released, under the action of magnetic forces of the third magnetic blocks 101 and the fourth magnetic blocks 103, the movable pad 40 will rotate automatically until a step of swapping is completed. The magnetic rotation correction system avoids problems of possible incomplete range and inaccurate angle of rotation by hand during fast operation. Based on this design, the step of swapping is completed merely by pushing, pulling or releasing the handle 62. The player can operate the toy easily and efficiently and does not need to constantly changing the positions and postures of the two hands. By using only two fingers, the player can complete two steps of alignment and swapping at instant. Preferably, the third magnetic block 101*s* are magnetic poles, and the fourth magnetic blocks 103 are magnetic blocks and the quantity is two. It can be understood that the third magnetic blocks 101 and the fourth magnetic blocks 103 may be in other shapes or quantities.

Figure 10:
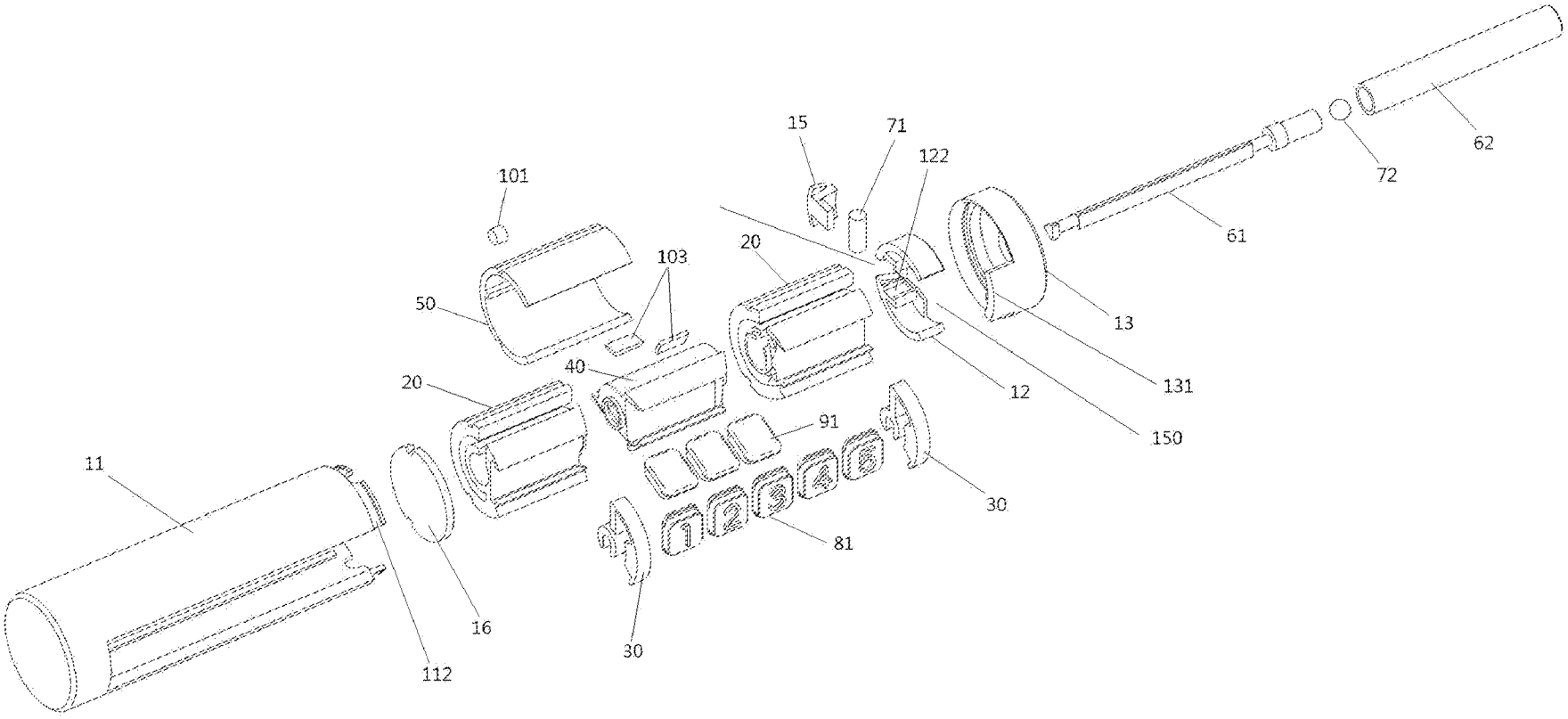
FIG. 10 is an exploded schematic view of a sliding intelligence toy in another embodiment of the present invention.
Figure 11:
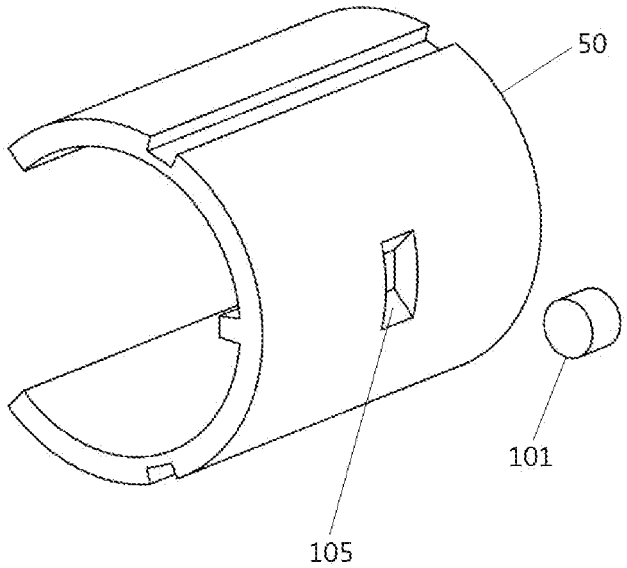
FIG. 11-FIG. 12 are structural schematic views of the back of a pad cover of the sliding intelligence toy shown in FIG. 10.
Figure 12:
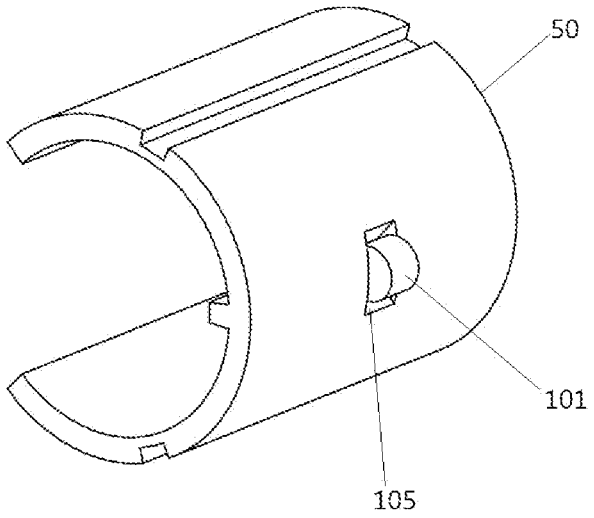
Figure 13:
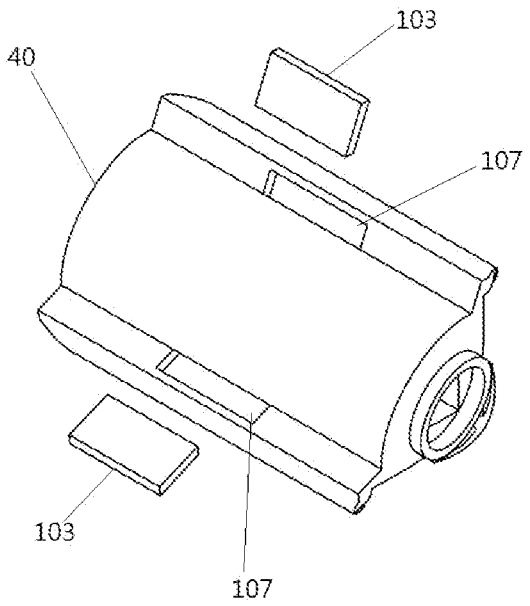
FIG. 13-FIG. 14 are structural schematic views of the back of a movable cover of the sliding intelligence toy shown in FIG. 10.
Figure 14:
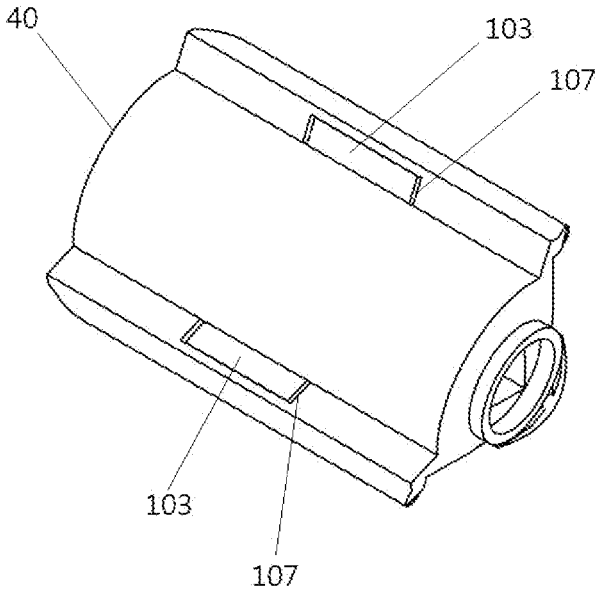

Further, the structure of the end cover 12 can be simplified, as shown in FIG. 10, the end cover 12 comprises a mounting position 122 to place a first magnetic block 71, and further comprises a notch 150 to allow a protruding portion 131 of the end cover cap 13 to pass through and be inlaid in a notch 111 of the housing body 11. The end cover 12 has only one tenon position 121. The tenon position 121 and two tenon portions 112 adjacent to the tenon position 121 are locked with a tenon piece 15, thereby connecting the end cover 12 to the housing body 11.

The foregoing embodiments only represent the preferred embodiments of the present invention. Their descriptions are concrete and detailed, but they shall not be therefore understood as limitations to the scope of the present invention patent. It should be noted that for those skilled in the art, various changes and modifications may be made to the embodiments without departing from the spirit of the present invention, such as: combinations of different features of the embodiments. All these fall within the protective scope of the present invention.

What is claimed is:

1. A sliding intelligence toy, comprising a housing, wherein the sliding intelligence toy further comprises two fixed pads fixed at two inner ends of the housing, a movable pad located between the two fixed pads, a connecting shaft structure passing through the two fixed pads and the movable pad, a first block structure and a second block structure; one end of the connecting shaft structure sticks out from one end of the housing and can move along the axial direction of the housing and rotate along the radial direction of the housing under the action of an external force, and the movable pad can rotate with the rotation of the connecting shaft structure; a push pad is vertically arranged on a side of each of the fixed pads, and sleeved to the connecting shaft structure and can move on a corresponding fixed pad with the movement of the connecting shaft structure; the first block structure comprises at least three closely adjacent first blocks slidably arranged in order on one side of the two fixed pads and the movable pad, the at least three first blocks are sandwiched between the push pads of the two fixed pads and the two first blocks at two ends are respectively located on the side of corresponding fixed pads, and remaining first blocks are located on the side of the movable pad; the second block structure comprises at least one second block slidably arranged at the bottom of the movable pad; first marks are arranged on the at least three first blocks respectively and a second mark is arranged on the at least one second block; at most two of the first blocks can be arranged on each of the fixed pads.

2. The sliding intelligence toy according to claim 1, wherein on a side of each of the fixed pads and the movable pad there is a first slideway and a second slideway extending along the axial direction of the housing respectively, the first slideway corresponds to the second slideway, and at the bottom of the movable pad there is a third slideway extending along the axial direction of the housing; the push pads may move on corresponding fixed pads along the first slideways with the movement of the connecting shaft structure; the at least three first blocks are slidably arranged inside the first slideway of the two fixed pads and inside the second slideway of the movable pad, the two first blocks at two ends are located inside the first slideway of corresponding fixed pads respectively, and remaining first blocks are located inside the second slideway of the movable pad, the at least one second block is slidably arranged inside the third slideway; at most two of the first blocks can be slidably arranged inside the first slideway of each of the fixed pads.

3. The sliding intelligence toy according to claim 1, wherein on the housing there is a watch window corresponding to the first block structure.

4. The sliding intelligence toy according to claim 3, wherein the housing comprises a housing body that is open at one end, an end cover that is connected to the open end of the housing body, and an end cover cap that is sleeved to the end cover, on the housing body there is a notch extending along the axial direction of the housing, and one end of the end cover cap has a protruding portion, which is inlaid in the notch to form the watch window.

5. The sliding intelligence toy according to claim 4, wherein the two fixed pads are fixed to two inner ends of the housing body respectively, and the fixed pad located inside the open end of the housing body is butted on the end cover; a gasket is arranged at the inner bottom of the housing body, and the fixed pad located at the inner bottom of the housing body is butted on the gasket.

6. The sliding intelligence toy according to claim 1, wherein the connecting shaft structure comprises a connecting shaft and a handle fixed to one end of the connecting shaft, and one end of the handle sticks out from one end of the housing; buckle positions are provided at two ends of the connecting shaft, and the two push pads are sleeved to corresponding buckle positions respectively.

7. The sliding intelligence toy according to claim 6, wherein the cross-section of the connecting shaft is in a triangular shape, the movable pad has an axial triangular through hole coordinating with the connecting shaft, and the connecting shaft coordinates with the triangular through hole so that the movable pad may rotate with the rotation of the connecting shaft structure.

8. The sliding intelligence toy according to claim 1, wherein the sliding intelligence toy further comprises a magnetic self-aligning device to drive the connecting shaft structure to automatically go back to an initial position; the magnetic self-aligning device comprises a first magnetic block and a second magnetic block, the first magnetic block is mounted inside the end cover of the housing, and the second magnetic block is mounted inside the handle of the connecting shaft structure and adjacent to the connecting shaft of the connecting shaft structure.

9. The sliding intelligence toy according to claim 8, wherein the first magnetic block is a magnetic pole and the second magnetic block is a magnetic ball.

10. The sliding intelligence toy according to claim 2, wherein each of the fixed pads has an axial through hole and the connecting shaft structure is sleeved into the through hole.

11. The sliding intelligence toy according to claim 10, wherein each of the push pads comprises a connecting portion and a butting portion formed on the periphery of the connecting portion, the connecting portion is sleeved to the connecting shaft structure, the butting portion comprises a first portion formed on the periphery of the connecting portion and an arc-shaped second portion connected to an end of the first portion, the top of the fixed pad has an opening communicated with the through hole, the first portion sticks out from the opening, and the second portion is around a side of the fixed pad adjacent to the first slideway.

12. The sliding intelligence toy according to claim 11, wherein first lugs protruding inwardly are arranged on two side walls of the first slideway respectively, and second lugs are arranged on inner side of the second portion and buckled between the first lugs on two side walls of the first slideway; two of the at least three first blocks that are located at two ends are butted on the second lugs of corresponding push pads.

13. The sliding intelligence toy according to claim 1, wherein the sliding intelligence toy further comprises a pad cover, which is fixed inside the housing, surrounds the periphery of the movable pad and has a recess corresponding to the first block structure; the inner periphery of the pad cover has a limiting portion, which is intended to limit the rotation angle of the movable pad.

14. The sliding intelligence toy according to claim 1, wherein the first block structure comprises three first blocks and the second block structure comprises a second block.

15. The sliding intelligence toy according to claim 14, wherein first marks arranged on the first blocks are numbers and the numbers on three first blocks are continuous; second marks arranged on the second blocks are English letters.

16. The sliding intelligence toy according to claim 1, wherein the first block structure comprises five first blocks and the second block structure comprises three closely adjacent second blocks arranged in order.

17. The sliding intelligence toy according to claim 16, wherein first marks arranged on the first blocks are numbers and the numbers on five first blocks are continuous; second marks arranged on the second blocks are English letters and the English letters on three second blocks are continuous.

18. The sliding intelligence toy according to claim 7, wherein an included angle is formed between the second slideway of the movable pad and the third slideway of the movable pad, and the symmetric center line of the included angle coincides with the symmetric center line of one of the angles of the triangular through hole.

19. The sliding intelligence toy according to claim 13, wherein the sliding intelligence toy further comprises a magnetic rotation correction system, which is intended to automatically complete a step of swapping and comprises third magnetic blocks and fourth magnetic blocks.

20. The sliding intelligence toy according to claim 19, wherein the third magnetic blocks are mounted at the center of the pad cover, and the fourth magnetic blocks are mounted at two ends of the back of the movable pad.

* * * * *